United States Patent [19]

McCarthy

[11] Patent Number: 4,867,328

[45] Date of Patent: Sep. 19, 1989

[54] SECTIONIZED TRASH RECEPTACLES

[76] Inventor: Maureen M. McCarthy, 610 8th Ave., Asbury Park, N.J. 07712

[21] Appl. No.: 102,032

[22] Filed: Sep. 29, 1987

[51] Int. Cl.[4] ..... B65D 90/00

[52] U.S. Cl. ..... 220/1 T; 220/22; 220/22.1; 220/22.3; 220/404

[58] Field of Search ..... 220/22, 22.1, 22.2, 220/22.3, 22.5, 404, 1 T; 108/61, 106, 110; 312/111, 330 R

[56] References Cited

U.S. PATENT DOCUMENTS

| | | | |
|---|---|---|---|
| 1,677,544 | 7/1928 | Brainard et al. | 220/22.3 |
| 2,491,750 | 12/1949 | McGavock | 220/22.3 |
| 3,656,651 | 4/1972 | Hage | 220/22.3 |
| 3,680,177 | 8/1972 | Ginsbery | 220/22.3 |
| 3,958,715 | 5/1976 | Capelli | 220/22 |
| 4,261,465 | 4/1981 | Thomas | 220/22.3 |
| 4,576,310 | 3/1986 | Isgar et al. | 220/404 |
| 4,735,340 | 4/1988 | Preston | 220/404 |

*Primary Examiner*—David T. Fidei
*Attorney, Agent, or Firm*—Charles I. Brodsky

[57] ABSTRACT

Apparatus for various embodiments of sectionalized trash receptacles, all specifically adapted to facilitate initial separation of solid waste at its point of generation into separate recyclable components, is disclosed herein. Each embodiment can separately store different recyclable components wherein the space allocated for each different component can be easily adjusted as the need arises.

11 Claims, 10 Drawing Sheets

SECTIONIZED TRASH RECEPTACLES

BACKGROUND OF THE INVENTION

1. Field of the Invention

The invention relates to apparatus for various embodiments of sectionalized trash receptacles all specifically adapted to facilitate initial separation of solid waste at its point of generation into separate recyclable components.

2. Description of the Prior Art

The proper disposal of commercial and residential trash is becoming increasingly problematical for many sections of the country and is reaching crisis proportions in some sections.

Specifically, for many years, solid waste (trash) has been collected from all generating sites, i.e. individual residences and commercial establishments, existing throughout a number of regions, such as separate municipalities, and then buried en mass in a land fill site. Hundreds of thousands of tons of waste are disposed in this fashion yearly. Now, many existing land fill sites are reaching their maximum capacity. Moreover, very few sites exist that are environmentally and politically suitable for use as new land fill sites. Consequently, the amount of available, i.e. unused, land fill space existing across the country is rapidly diminishing. In addition, increased use of other forms of trash disposal, such as ocean dumping and/or incineration, are expensive, potentially hazardous, and often take years to implement. Consequently, these other forms are meeting with increased opposition and thus can not be looked upon to provide any additional capacity for trash disposal. Therefore, in the absence of suitable alternatives and to allow existing land fill sites to accept additional trash for as long an interval of time as possible, management personnel at many land fill sites are severely limiting the number of municipalities each land fill site will serve and the amount of trash that each municipality can bury in the land fill site.

One way to extend land fill capacity out over time is to collect those components of solid waste that are easily amenable to being recycled and keep them out of the waste stream that is destined for burial at a land fill. These recyclable materials typically include newspaper, high grade paper, cardboard, glass containers and aluminum cans. Once collected these components can be transported to a recycling plant for re-manufacture and eventual reuse thereby effectively removing the recyclable materials from the waste stream. Approximately, as reported in "Should New Jersey Have a Bottle Bill?", The Asbury Park Press, June 15, 1987, page A21 newspapers, corrugated and other paper represent approximately 47% of the solid waste stream, yard waste accounts for approximately 10–15%, glass comprises approximately 6–7%, aluminum represents approximately 1%, plastic accounts for approximately 7%, food scraps accounts for approximately 8% and some 16% of the solid waste stream consists of other materials.

It has been estimated that recycling can reduce solid waste destined for burial at a land fill site by a substantial amount and thereby effectively extend the life of existing land fill sites for a number of years. This period of time should, it is hoped, be sufficient to enable society to develop alternate mechanisms for solid waste disposal.

Recycling is not a new idea and, in fact, has been used, at least on a voluntary basis, for quite a number of years. Unfortunately, voluntary compliance has not reached a level sufficient to have an appreciable impact on reducing the size of the solid waste stream. Various states are now considering the use of mandatory recycling and one state, New Jersey, has enacted a mandatory recycling act. Through this act, New Jersey counties, in conjunction with their member municipalities, are required to develop plans, collect and recycle three materials, plus leaves, from their solid waste streams. The goal of the act is to reduce the volume of solid waste by approximately 25% in an 18 month period starting from the date mandatory recycling begins in New Jersey.

For mandatory recycling to work effectively, every solid waste generator, whether it is an individual in a residence or an individual in a commercial or industrial establishment, must separate solid waste as soon as it is generated. This means that the individual must separate recyclable materials (components) of trash he or she generates, such as newspaper, cardboard, glass and aluminum, from non-recyclable trash, such as food scraps, for separate storage and subsequent transport to an appropriate recycling center.

Generally, to institute recycling at a location, a separate waste container is designated to hold a particular recyclable component. For example, one container can be labelled for storing aluminum only, another for storing cardboard only, a third for storing high grade paper only and a fourth for storing glass only. In this manner, the contents of each trash receptacle can be collected for shipment to a particular recycling center separately from other recyclable materials.

Various arrangements exist in the art to secure multiple trash receptacles in a common area. These are typified by the arrangements shown in U.S. Pat. Nos. 3,288,305 (issued to F. C. Bryant et al on Nov. 29, 1966); 3,105,594 (issued to R. S. Ewers on Oct. 1, 1963); 3,065,858 (issued to R. H. Furr on Nov. 27, 1962 and United States design patent 214,644 (issued to D. B. Maris on July 8, 1969). Unfortunately, all of these arrangements possess common drawbacks when used in recycling multiple recyclable components occurring in a solid waste stream. First, these prior art arrangements are all bulky and hence occupy a relatively large amount of floor space. Second and more important, the size of each trash receptacle used in each of these arrangements is approximately the same. Hence, since the amount of each recyclable component accumulates at a different rate from that of the others, each receptacle in these prior art arrangements will likely fill at a different rate than that of the other receptacle(s). For example, since aluminum constitutes only 1% of the waste stream while paper products account for 47%, the receptacle designated to store aluminum will remain relatively empty while the receptacle designated to store paper products will fill and need to be emptied several times. Generally, all the receptacles in any such arrangement are emptied at once. To ensure that solid waste does not overflow any receptacle, the rate at which any of these prior art arrangements will need to be emptied by a laborer will usually be dictated by the fill rate of the container designated for the recyclable component that occupies the largest share of the solid waste stream. Therefore, most of the receptacles will be emptied before they are full and hence at an excessive rate. This, in turn, wastes labor.

Different waste generators generally produce waste streams with correspondingly different amounts of each recyclable component and even the same generator produces a waste stream that typically has differing amounts of recyclable components at different times. Inasmuch as the capacity of each receptacle contained in the prior art arrangements can not be sized to coincide with volumetric percentages of each recyclable component in the waste stream that are, in fact, and/or ar expected to be produced by each generator, these prior art arrangements are not ideally suited for use with efforts aimed at recycling multiple recyclable components Therefore, a need exists in the art for a non-bulky trash receptacle that can separately store different types of solid waste wherein the storage capacity allocated to each type of waste can be readily changed as necessary to coincide with the amount of that type of waste that is expected to be and/or is being generated. Such a receptacle would advantageously be particularly suited for use in separately storing each different recyclable component occurring in a solid waste stream and would minimize space and labor requirements.

SUMMARY OF THE INVENTION

Accordingly, an object of the present invention is to provide a trash receptacle that can separately store different recyclable components at the point of generation of a solid waste stream.

Another object is to provide such a trash receptacle in which the amount of storage capacity allocated to each recyclable component can be readily changed to coincide with the expected amount of that component which is expected to be generated and/or is being generated.

A further object is to provide such a trash receptacle that can be adjusted to provide a proper amount of storage capacity for each recyclable component and hence reduce the attendant labor required to periodically empty the entire receptacle.

A further object is to provide such a receptacle that is not bulky and hence conserves floor space.

These and other objects are accomplished in accordance with the teachings of the present invention by apparatus which comprises: a container formed of a cylinder being open at one end thereof and having a base with a pre-defined geometric shape at an opposite end thereof; and at least one partition disposed within the container and oriented substantially parallel to a side wall of said cylinder, wherein the partition extends between two oppositely situated side walls of the container and runs from the base of said container to substantially the top thereof so as to divide the container into separate pre-defined compartments for separately storing different respective recyclable materials therein.

Alternatively, one end of all of these partitions can be connected to a common hinge which is oriented along a central axis of the container. A series of detents are positioned in pre-defined locations around an inner surface of the container. A partition can be rotatably pivoted into a pre-defined position where the partition will abut against and be held in place by the detent located there. In this way, the partitions can be rotated to define a plurality of appropriately sized compartments.

BRIEF DESCRIPTION OF THE DRAWING

The teachings of the present invention can be readily understood by considering the following detailed description in conjunction with the accompanying drawing, in which:

FIG. 22 depicts a top view of the embodiment shown in FIG. 20.

To facilitate understanding, identical reference numerals have been used to denote identical elements that are common to the figures.

DETAILED DESCRIPTION

After reading the following description, those skilled in the art will readily appreciate the teachings of the present invention are applicable to any container that is used to store separate items in different compartments of the container, regardless of whether the items placed in all the compartments are the same or not. For purposes of illustration, the invention will be discussed in the context of a trash (solid waste) receptacle particularly suited to separately store different recyclable components present in a waste stream at the point of its generation.

Figure 1:
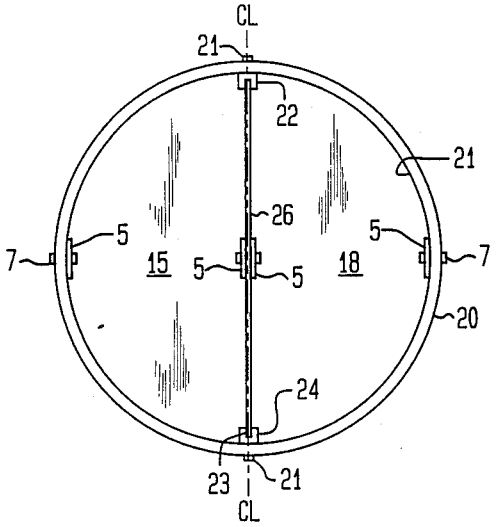
FIG. 1 depicts a top view of a first embodiment of the inventive trash receptacle that incorporates the teachings of the present invention.
Figure 2:
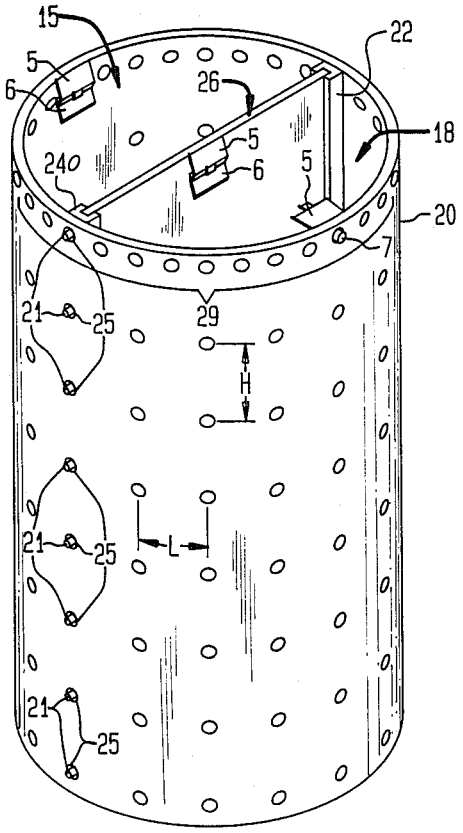
FIG. 2 depicts a front perspective view of the embodiment shown in FIG. 1.

FIG. 1 depicts a top view of a first embodiment of the inventive trash receptacle that incorporates the teachings of the present invention. A front perspective view of this embodiment is depicted in FIG. 2. The reader should consider both of these figures during the following discussion. As shown in these figures, the trash receptacle is formed of container 20, which is a circular cylinder open at its top end, into which partition (dividing wall) 26 is placed substantially parallel to the side wall of the container in order to divide the container into two separate compartments 15 and 18. The cylinder has a circular base. Such a receptacle is suited for those installations which require storage of only two different recyclable components, such as aluminum and high grade paper. Container 20 (as well as the containers shown herein for each of the other embodiments) can be formed of any well known material, such as a suitable plastic or metal, illustratively steel or aluminum, which provides sufficient strength and rigidity in view of the size and weight of the expected recyclable items that will be stored in the container. Also, this material should preferably be impervious to moisture and sunlight since the receptacle is likely to be stationed outdoors. Furthermore, a well-known tightly fitting lid (not shown), typified by any one of many different ones presently used in connection with trash cans, should be placed over the top of the receptacle to protect its contents and prevent spillage thereof.

Partition 26, which extends substantially the entire height of the container, is held in place by identical runners 22 and 24 that each contain a U-shaped guide or channel, such as channel 23 in runner 24. Each runner is secured to inner wall 21 of container 20 by a series of pins 21 that protrude from a rear surface of the runner and mate with and extend through a corresponding column (vertical series) of holes 25 located on container 20. Similar columns of holes preferably extend horizontally around the entire periphery of container 20 with preferably, though not necessarily, equal inter-column spacing therebetween, as shown. Once both runners have been appropriately secured at desired opposed locations along inner wall 21, partition 26 is then slid in place between the U-shaped channels of the both runners. Partition 26 (as well as the partitions shown herein for each of the other embodiments) can be made of any well-known material, such as masonite, metal or aluminum, which provides sufficient rigidity. Runners 22 and 24 (as well as those shown in each of the other embodiments discussed hereinbelow) can each be made of a sufficiently resilient material, such as a rubber based material or a suitable plastic, that compresses slightly whenever partition 26 is inserted therebetween so as to securely hold the partition in position, particularly when each compartment of the receptacle is being emptied. Alternatively, these runners can be fabricated from a well known non-resilient material, such as masonite or bakelite or even metal, depending upon the desired characteristics of the runners. Although these runners are shown as essentially extending the entire height along inner wall 21 of container 20, the height of each runner can, in fact, be shortened considerably to extend a distance, "H", that is slightly larger than the spacing between two adjacent ones of holes 25, or even extend an even smaller distance, if desired, provided the runners remains at least sufficiently high to accommodate a pin 21 affixed to its rear surface.

Although the runners are shown as being positioned along a centerline ("CL—CL")of container 20 such that compartments 15 and 18 are identically sized, these runners can be positioned at any two opposed locations along inner wall 21 as long as partition 26 is appropriately sized to fit within the U-shaped channels and fully extend between runners. In this manner, compartments 15 and 18 can be sized to provide different storage capacities such that the inventive receptacle meets the expected rate at which all the different recyclable items stored therein accumulates. In this manner, the size of each compartment can be readily adjusted such that each compartment fills at approximately the same rate. As a result, a laborer can be scheduled to empty the receptacle at the end of a periodic interval which is designed to allow both compartments 15 and 18 to completely fill. In this manner, the laborer will not waste time by visiting the receptacle an excessive number of times to empty one compartment that has a high fill rate and another that has not yet been filled.

Figure 3:
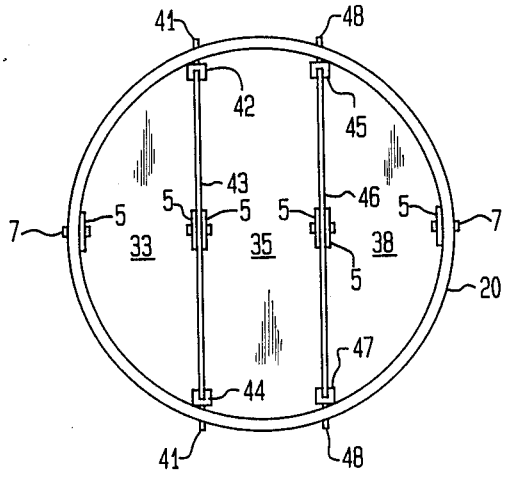
FIG. 3 depicts a top view of a second embodiment of the inventive trash receptacle.

Typically each of compartments 15 and 18 formed in container 20 are lined with a storage bag (not shown but well known), such as a suitably sized plastic garbage bag, to facilitate easy collection and removal of the recyclable items placed into each compartment. Each storage bag, maintained in any compartment, is held open by two oppositely disposed ones of spring clips 5 situated within that compartment. A portion of the top edge of a bag is placed under each spring clip and is thus held in place thereby. For compartment 15, a first one of clips 5 is attached to inner wall 21 and a second one of clips 5 is suitably attached to the left hand surface of partition 26 in an opposing relationship to the first clip; opposing portions of the top edge of one bag are then placed under these two clips. Likewise, for compartment 18, a third one of clips 5 is attached to inner wall 21 and a fourth one of clips 5 is suitably attached to the right hand surface of partition 26 in an opposing relationship to the third clip; opposing portions of the top edge of one bag are then placed under these two clips. Each spring clip is well known and can be fabricated by an arm that is held by a spring hinge against a front surface of small flat plate 6. The bag edge is inserted between arm 5 and plate 6 and is held in place by the spring action of the hinge situated between the arm and plate. Plate 6, used in each of the clips that is attached to container 20, has a short pin 7 extending from its rear surface thereof. This pin mates with and extends through a corresponding hole located within a row of closely spaced holes 29 that are situated near the top edge of container 20. In contrast, the clips that are affixed to either surface of partition 26 do not include such pins and are instead fixedly held in place on the partition by well known fasteners, such as rivets or screws (not shown). To ensure that the clips are firmly held in place, the diameter of each of holes 5 approximately matches the diameter of pin 7 such that a relatively tight fit occurs between any such pin on a clip and any one of holes 5. Adjacent ones of holes 5 are spaced closer apart than adjacent ones of holes 25 in order to provide the user with a large choice in determining where to mount clips to the inside wall of container 20. Although one clip is shown mounted, within each compartment, to inside wall 21 of container 20, two or more clips can be so mounted, if the user desires, and collectively used to keep a storage bag open. For ease of construction, the diameter of each of holes 25 may match that of holes 29. However, the diameter of each of pins 21 is suitably smaller than that of holes 25 such that each runner can pivot, if necessary, against inside surface 21 and near a column of holes (such as shown in FIG. 3) such that the runner can pivot away from inner surface 21 and remain parallel to a partition, thereby allowing the runner to be mounted in positions other than along centerline CL—CL shown in FIG. 1. The partition is appropriately sized to firmly hold both runners against inner surface 21. Hence, even though the runner may pivot and/or move about somewhat when first installed in its position, once partition 26 is slid into place between two opposing runners 22 and 24, the runners become oriented parallel to the partition and are firmly secured in place by the partition. Clips 5 and mounting holes 29 are utilized in each of the other embodiments, and hence will not be discussed any further. The length of pins attached to the runners and those attached to various ones of clips 5 have been exaggerated in these figures for purposes of illustration. Moreover, to simplify the drawings, plates 6 have been eliminated from the top views appearing in FIGS. 1, 3, 5, 9, 13, and 20.

Figure 4:
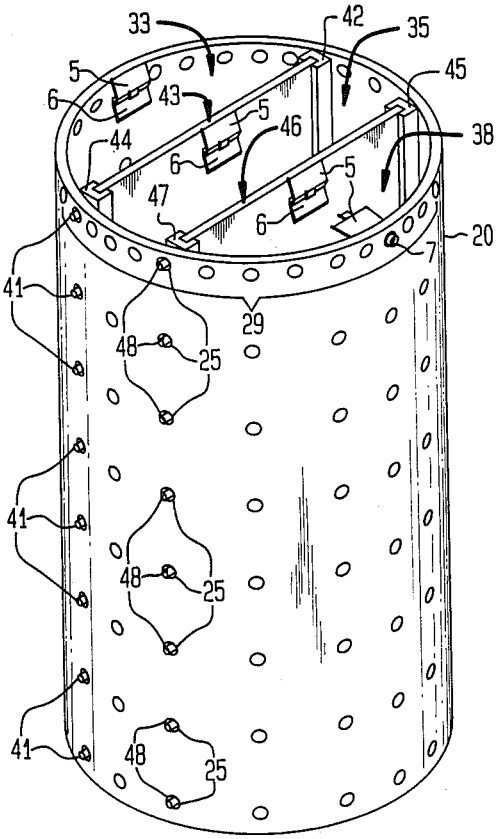
FIG. 4 depicts a front perspective view of the embodiment shown in FIG. 3.

FIG. 3 depicts a top view of a second embodiment of the inventive trash receptacle. FIG. 4 depicts a front perspective view of this embodiment. Here, as shown in both figures, a receptacle is again formed of container 20, which is a cylinder open at its top end, into which partitions 43 and 45 are appropriately placed to partition the container into three separate compartments 33, 35 and 38. Such a receptacle is suited for storing three different recyclable components, such as aluminum, glass containers and high grade paper. Runners 42 and 44, and 45 and 47 are respectively used to secure partitions 43 and 46 in desired locations and function in the same manner as runner 22 and 24, shown in FIG. 1. Pins 41, similar to pins 21, extend from the rear surface of runner 44 and mate with and protrude through a corresponding column of holes 25. Runner 42 is mounted in a similar fashion to container 20. Likewise, pins 48, also similar to pins 21, extend through the rear surface of runner 47 and mate with and protrude through a corresponding column of holes 25. Runner 45 is mounted in a similar fashion, as is runner 47, to container 20. As with pins 21, the diameter of pins 41 and 48 is smaller than that of holes 25 in order to permit these pins to move within the holes thereby permitting runners 44 and 47 to each pivot (as shown in FIG. 4) and assume a position substantially parallel to that of a partition whenever partition 43 and 46 is installed between runners 42 and 44, and 45 and 47, respectively. This embodiment also contains two separate ones of clips 5 mounted to the inside surface of container 20 and four different ones of clips 5 mounted to partitions 43 and 46, in the same manner as described forth above.

Figure 5:
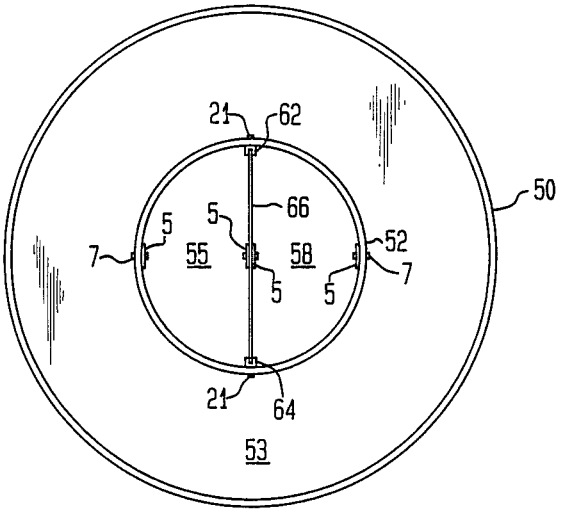
FIG. 5 depicts a top view of a third embodiment of the inventive trash receptacle.
Figure 6:
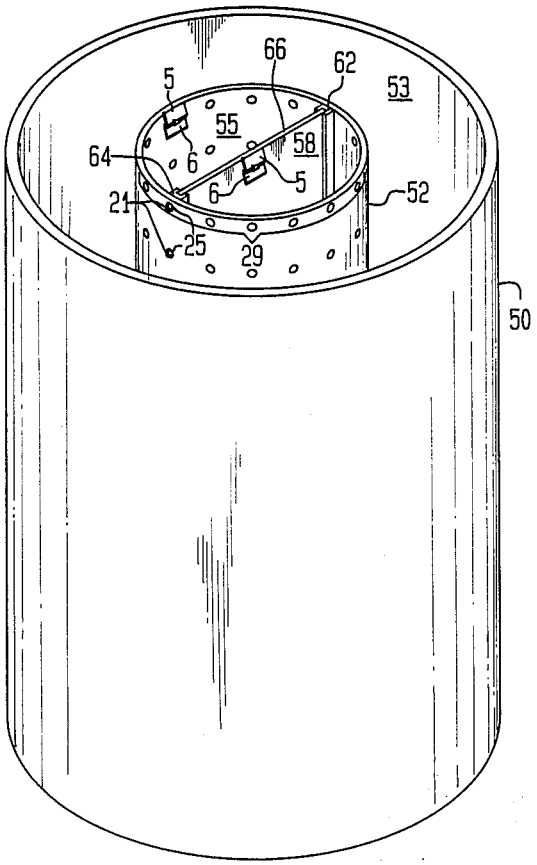
FIG. 6 depicts a front perspective view of the embodiment shown in FIG. 5.

FIG. 5 depicts a top view of a third embodiment of the inventive trash receptacle. A front perspective view of this embodiment is depicted in FIG. 6. As shown in these figures, the trash receptacle is formed of cylindrical container 52, which is open at its top end, into which partition (dividing wall) 66 is placed to partition the container into two separate compartments 55 and 58. Partition 66 is substantially similar to partition 26 as described above. Runners 62 and 64 secure partition 66 to the inner surface of container 52 in much the same fashion as runners 22 and 24, shown in FIG. 1 and discussed above, and are substantially similar thereto. Container 52 is situated inside of and concentrically aligned with a larger cylindrical container 50, which is also open at its top end. Container 52 is secured to container 50 by suitable fasteners, such as rivets, bolts or the like, that extend through the bottom of both containers. As a result, annular compartment 53, situated between the inner wall of container 50 and the outer wall of container 52, is available to separately store a third recyclable component apart from those stored within compartments 55 and 58. A recyclable component such as paper, which constitutes a considerably larger volume of the solid waste stream than does other components, such as aluminum, would preferably be stored within annular compartment 53. Any two of the other components, each of which constitutes a fairly small percentage of the volume of the solid waste stream, could preferably be separately stored within compartments 55 and 58. As in the embodiment shown in FIG. 1, partition 66 is not limited to being located along the centerline of container 52, as shown, but instead can be located in any one of a variety of different positions so as to set the size of compartments 55 and 58 accordingly. Specifically, runners 62 and 64 can be positioned at any two opposed locations along the inner wall of container 52 as long as partition 66 is appropriately sized to fit within the U-shaped channels of the runners and fully extend therebetween. This embodiment also contains various ones of clips 5 situated within container 52 for use in keeping storage bags, located within compartments 55 and 58, open. Due to the annular shape of compartment 53, no storage bag would probably be used here.

Figure 7:
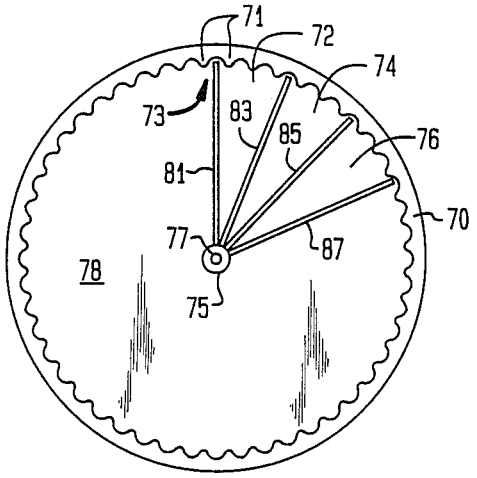
FIG. 7 depicts a top view of a fourth embodiment of the inventive trash receptacle.
Figure 8:
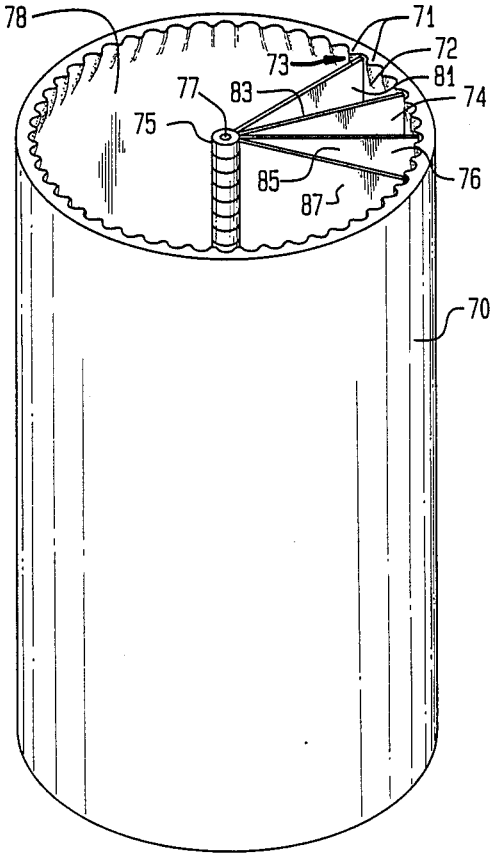
FIG. 8 depicts a front perspective view of the embodiment shown in FIG. 7.

FIG. 7 depicts a top view of a fourth embodiment of the inventive trash receptacle. A front perspective view of this embodiment is shown in FIG. 7. Here as shown in these figures, the trash receptacle is formed of cylindrical container 70 which is open at its top end. A number of separate movable partitions 81, 83, 85 and 87 are all attached, via respective fingers, to a common hinge 75, which is preferably a piano hinge. The hinge is positioned along a central axis of container 70. Hinge pin (shaft) 77 prevents the hinge from coming apart. A series of ribs, such as adjacent ribs 71, is uniformly located around the inner wall of container 70 thereby forming a series of detents (or valleys), such as detent 73, situated between any two adjacent ribs. In use, partitions 81, 83, 85 and 87 can be rotated around hinge 75 and separately secured in place at four respective detents. This permits the available space located within container 70 to be divided into four separate compartments 72, 74, 76 and 78. The position of partitions 81, 83, 85 and 87 can be set by the user to define the desired size of each compartment. The size of these compartments need not be the same but can advantageously be set to provide the necessary capacity that approximately matches the volumetric percentage of each desired recyclable component appearing in a solid waste stream. Although clips 5 are not shown in this embodiment, these clips can, in fact, be mounted to the partitions in the same manner as described above, if storage bags are to be used.

Figure 9:
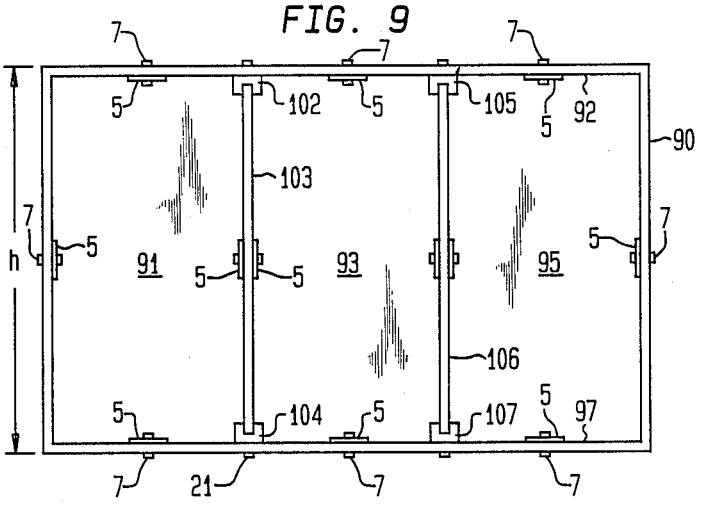
FIG. 9 depicts a top view of a fifth embodiment of the inventive trash receptacle.
Figure 10:
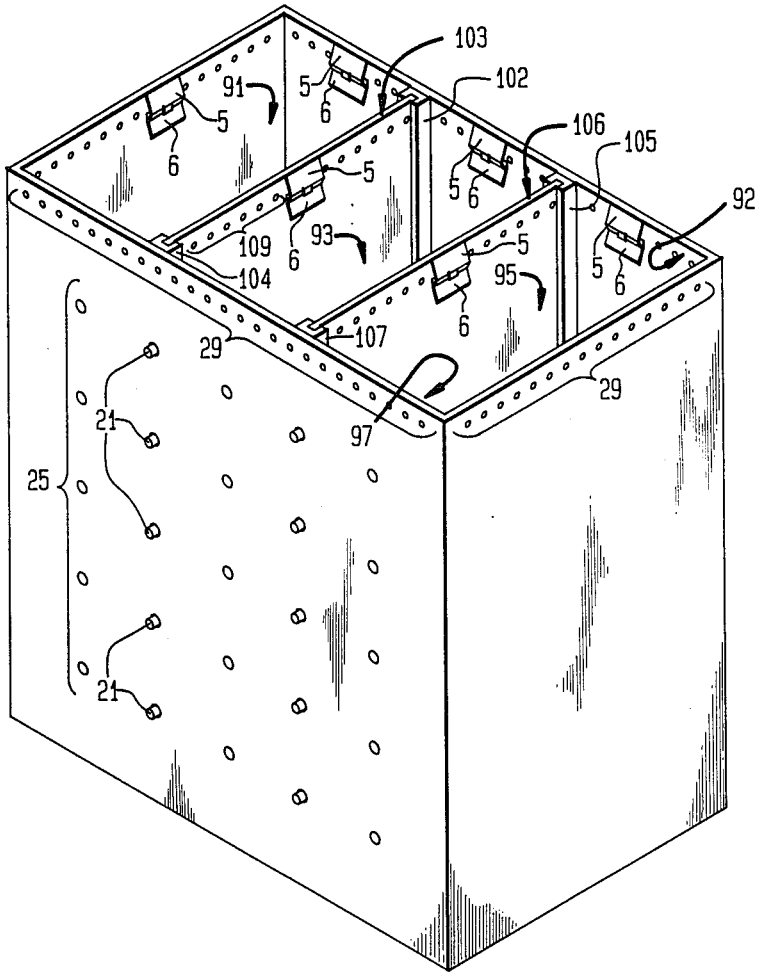
FIG. 10 depicts a front perspective view of the embodiment shown in FIG. 9.

FIG. 9 depicts a top view of a fifth embodiment of the inventive trash receptacle. A front perspective view of this embodiment is shown in FIG. 10. As shown in these two figures, this embodiment is very similar to that shown in FIG. 3 except rectangular container 90 is used instead of a cylindrical container. In this case, the container is rectangularly shaped, i.e. with rectangularly shaped side walls and a rectangularly shaped base, instead of a circularly shaped cylinder shown in FIGS. 1–8. Specifically, as shown in FIG. 9, the receptacle is formed of container 90, which has a rectangular frame open at its top end, into which partitions 103 and 106 are appropriately placed to partition the container into three separate compartments 91, 93 and 95. Such a receptacle is suited for storing three different recyclable components, such as aluminum, glass containers and high grade paper. Runners 102 and 104, and 105 and 107 are respectively used to secure partitions 103 and 106 in desired locations and function in the same manner as runners 22 and 24, shown in FIG. 1. Runners 102 and 104, and 105 and 107 can be appropriately positioned at corresponding opposing locations along inner walls 92 and 97 of container 90 to form appropriately sized compartments. These runners again utilize pins 21 which mate with a corresponding column of holes 25. Here, however, all the partitions can be cut to the same dimensions since all the compartments have a common height, i.e. dimension "h". As a result, any or all of the partitions can be easily repositioned as the need arises, in order to provide sufficient capacity in the compartments necessary to meet changing amounts of stored recyclable components in the solid waste stream, without the need to alter the size of any partition. In addition, since the inside surface of container 90 is rectangularly shaped and the size of all the partitions is the same, there is no need to allow the runners to pivot about, as is required with circularly shaped containers. As a result, the diameter of holes 25 can be approximately the same as the diameter of pins 21 such that the runners will readily maintain their position when mated to container 90. This embodiment, like some of the others, also includes a number of clips 5, substantially similar to those discussed above, located within each compartment in order to assist in keeping a storage bag situated therein open. Due to the rectangular nature of each compartment, four clips are preferably used therein. Partitions 103 and 106 both contain a series of narrowly spaced holes 109, of which a few are indicated by the reference number, extending across the entire partition near its top edge. Each of the clips that is mounted to the partitions contains pin 7 protruding from rear plate 6 associated therewith which mates with one of the holes 109. In this manner, the user can position the clips, where desired, and appropriately secure it in place by mating its pin 7 with a desired one of holes 109. The diameter of these holes approximately matches that of the diameter of pin 7 in order to provide a tight and secure fit therebetween.

Figure 11:
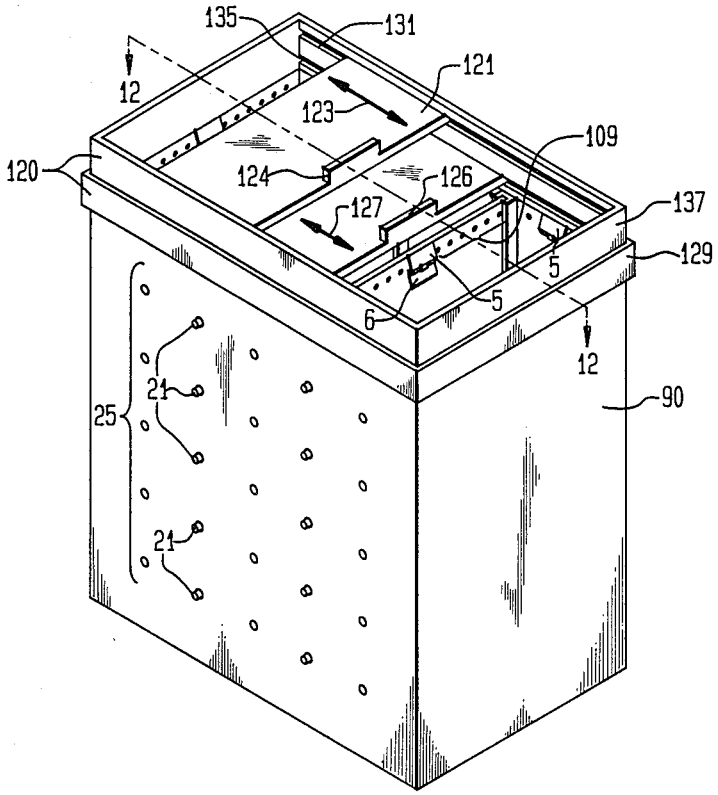
FIG. 11 depicts a front perspective view of a sixth embodiment of the inventive trash receptacle.
Figure 12:
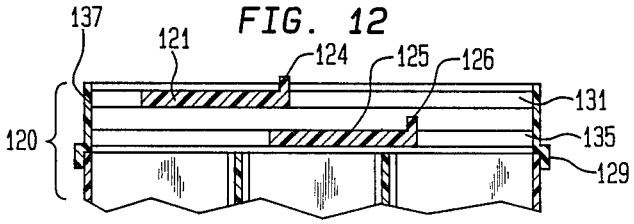
FIG. 12 depicts a partial cross-sectional view, taken along lines 12—12, of the embodiment shown in FIG. 11.
Figure 13:
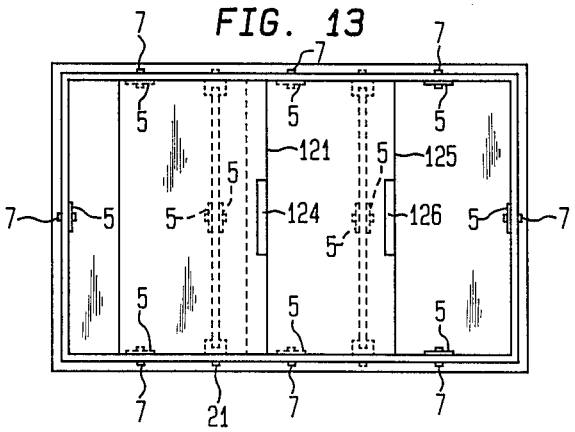
FIG. 13 depicts a top view of the embodiment shown in FIG. 11.

FIG. 11 depicts a front perspective view of a sixth embodiment of the inventive trash receptacle. A partial cross-sectional view of this embodiment taken along lines 12—12 in FIG. 11 is depicted in FIG. 12. A top view of this embodiment is shown in FIG. 13. As shown in these figures, this embodiment utilizes the sectionalized receptacle shown in FIGS. 9 and 10 with the addition of top assembly 120. This assembly includes a rectangular frame member formed of upper frame member 137 and skirt 129. In use, the top assembly is merely slid into place onto the top of receptacle 90 such that skirt 129 abuts against and overhangs the top edge of the receptacle. Upper frame member 137 contains two channels 131 and 135 that are cut into the material that forms two opposing sides of the frame member, of which the channels in one of these sides is shown in the perspective view of FIG. 11. During manufacture of top assembly 120, panels 121 and 125 are positioned to fit within opposing channels 131 and 135, respectively. Each of these panels is preferably sized to cover approximately one third of the width of the open receptacle and to easily slide back and forth in the directions of arrow 123 for panel 121 and arrow 127 for panel 125. Handles 124 and 126, which permit the user to easily grab and slide each of the panels, form part of panels 121 and 125, respectively, and are merely upward extensions of these panels as is evident in the cross- sectional view in FIG. 12. This embodiment, as with the receptacle shown in FIGS. 9 and 10, contains a number of clips 5 positioned within each of the compartments. Through use of the sliding panels, this embodiment permits the user to expose any one of the compartments at a time while keeping the others closed. Hence, this advantageously reduces the chance that a recyclable item will be placed into the wrong compartment.

Figure 14:
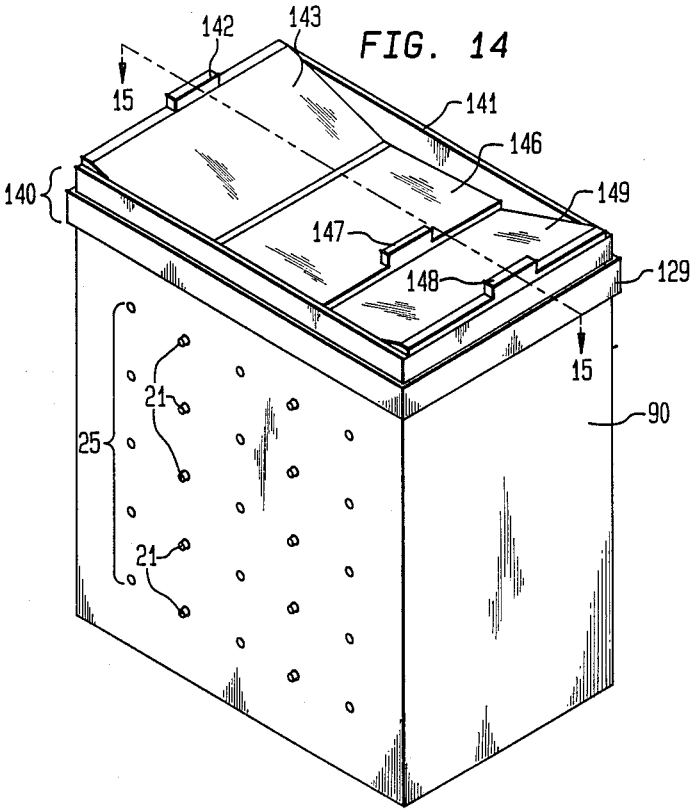
FIG. 14 depicts a front perspective view of a seventh embodiment of the inventive trash receptacle.
Figure 15:
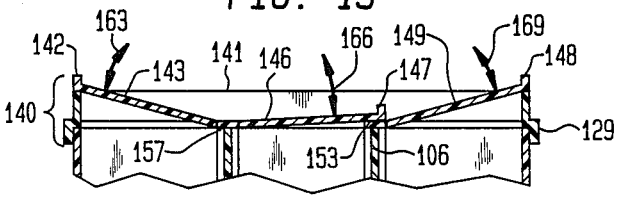
FIG. 15 depicts a partial cross-sectional view, taken along lines 15—15, of the embodiment shown in FIG. 14.
Figure 16:
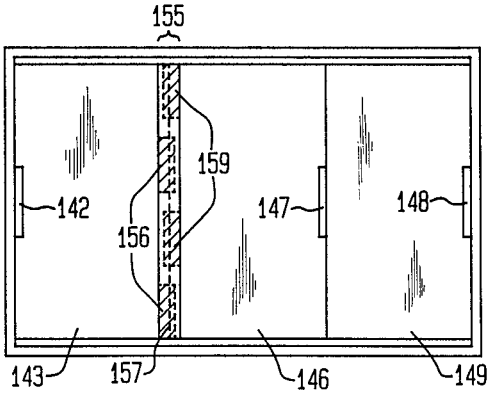
FIG. 16 depicts a top view of the embodiment shown in FIG. 14.

FIG. 14 depicts a front perspective view of a seventh embodiment of the inventive trash receptacle. A partial cross-sectional view of this embodiment taken along lines 15—15 is depicted in FIG. 15. A top view of this embodiment is shown in FIG. 16. Here, the receptacle is the same as that shown in FIGS. 9 and 10 with the addition of top assembly 140. In contrast to top assembly 120 shown in FIGS. 11 and 12, top assembly 140 contains panels (doors) that pivot outward to provide access into the separate compartments within the receptacle rather than sliding back and forth as do panels 121 and 125. Specifically, top assembly 140 contains three separate doors 143, 146 and 149 that each pivots along an arc in a direction defined by arrows 163, 166 and 169, respectively. Each door contains a handle at one end and is connected to a substantially identical hinge at the other end. For example, door 143 has handle 142 attached to one end thereof. Fingers 156, which form part of hinge 155, extend from an end of door 143 and are interleaved between corresponding fingers 159 attached to one end of door 146. Hinge pin 157 extends through an axially aligned longitudinal hole situated in all of these fingers thereby creating a hinge for doors 143 and 146. Handle 147 appears on an end of door 146 oppositely situated from the hinge. Door 149 which contains handle 148 at one end thereof is hinged at the other end to the top of partition 106, via hinge pin 153. Specifically, one set of separated fingers (identical to fingers 156 but not specifically shown) is secured to the top of partition 106 along its top edge. Another set of fingers (identical to fingers 159 but not specifically shown) extend beyond the left side of door 149 and interleave with those fingers affixed to the partition. Hinge pin 153 is inserted through an axially aligned longitudinal hole situated in all of these fingers thereby creating a hinge for door 149.

Figure 17:
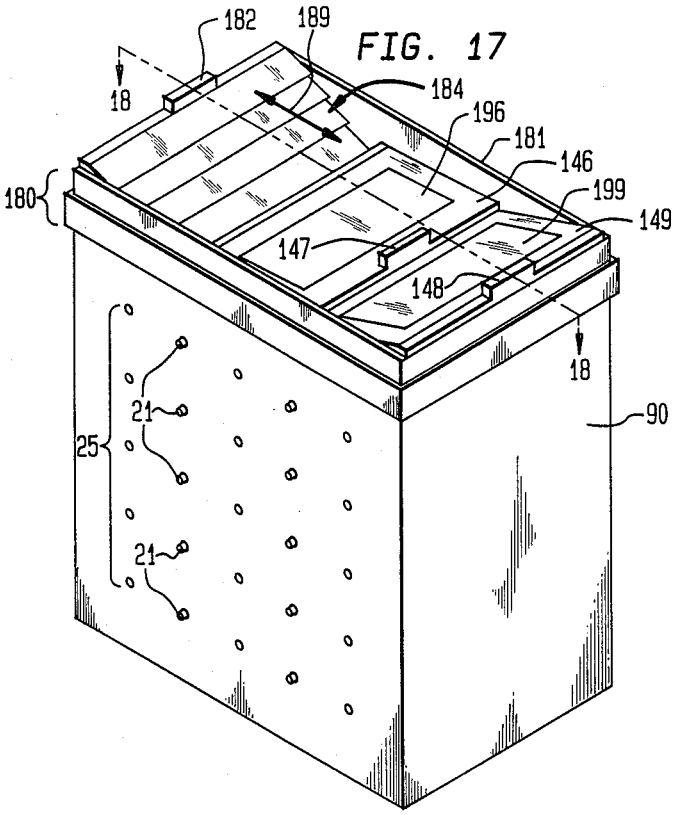
FIG. 17 depicts a front perspective view of a eighth embodiment of the inventive trash receptacle.
Figure 18:
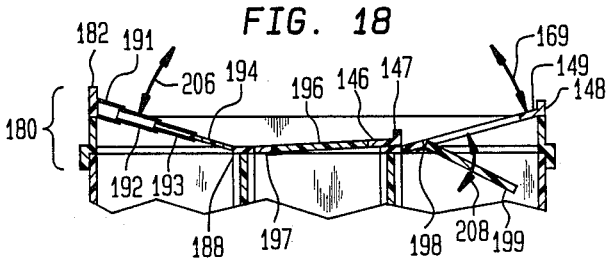
FIG. 18 depicts a partial cross-sectional view, taken along lines 18—18, of the embodiment shown in FIG. 17.
Figure 19:
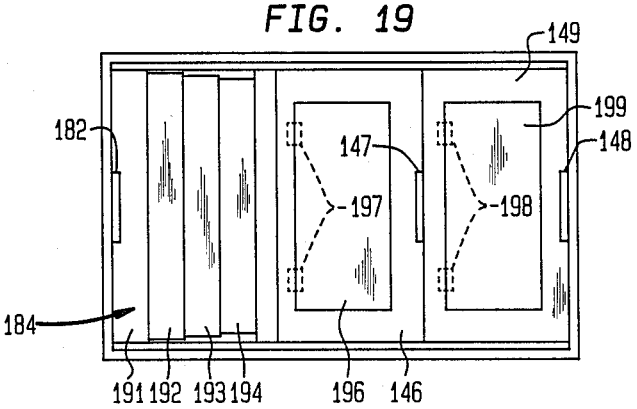
FIG. 19 depicts a top view of the embodiment shown in FIG. 17.

FIG. 17 depicts a front perspective view of an eighth embodiment of the inventive trash receptacle. A partial cross-sectional view of this embodiment taken along lines 18—18 is depicted in FIG. 18. A top view of this embodiment is shown in FIG. 19. Here, the receptacle is very similar to that shown in FIGS. 14–16 with the addition of spring loaded sub-panels 196 and 199 located within respective rectangular cutouts in doors 146 and 149, and use of a telescoping door 184 in lieu of fixed length door 143 (see FIG. 14). Specifically, sub-panels 196 and 199 have been incorporated within the central portion of doors 146 and 149 and are mounted to these doors by respective well known spring-loaded hinges 197 and 198. With this structure, the user need not open a door to insert moderately sized recyclable material in one of the compartments, but can instead place the material on top of the sub-panel for the door (146 or 149) to the desired compartment at which point gravity will cause the sub-panel to pivot downward, in the direction given by arrow 208, and let the material fall into the compartment. Once this occurs, the spring action of the hinge, such as hinge 198, will cause the sub-panel to pivot upward, in the direction shown by arrow 208, to temporarily close the compartment. Through this arrangement, the user advantageously saves time and effort.

Door 184 is formed of four separate telescoping sections 191, 192, 193 and 194. In this manner, the width of the door can be increased or decreased by a user in order to match the width of the compartment situated under this door. Oftentimes, after the user has appropriately partitioned the receptacle to contain a number of similarly sized compartments, one compartment will remain that has a totally different width altogether. In those instances where a standard sized door will not fit this compartment (i.e. the door will either be too narrow and not cover the compartment or be too wide and extend out beyond a wall of the compartment), telescoping door 184 can be used to cover this compartment. In this case, the user will appropriately move handle 182 to expand telescoping sections 191, 192, 193 and 194, in a lateral direction given by arrow 189, to extend to a desired width. Each telescoping section can be manufactured of a suitable metal, such as aluminum, or a suitable plastic. Section 194 is mounted to the receptacle using a hinge which is substantially identical to hinge 155 (see FIG. 16). This hinge contains hinge pin 188 which functions in a substantially identical manner as does hinge pin 157 (see FIGS. 15–16).

Although this embodiment is shown with two doors, each having a spring-loaded sub-panel, and one telescoping door, a receptacle can contain any number of doors wherein any door can contain such a sub-panel or be telescoping, if the need arises.

Figure 20:
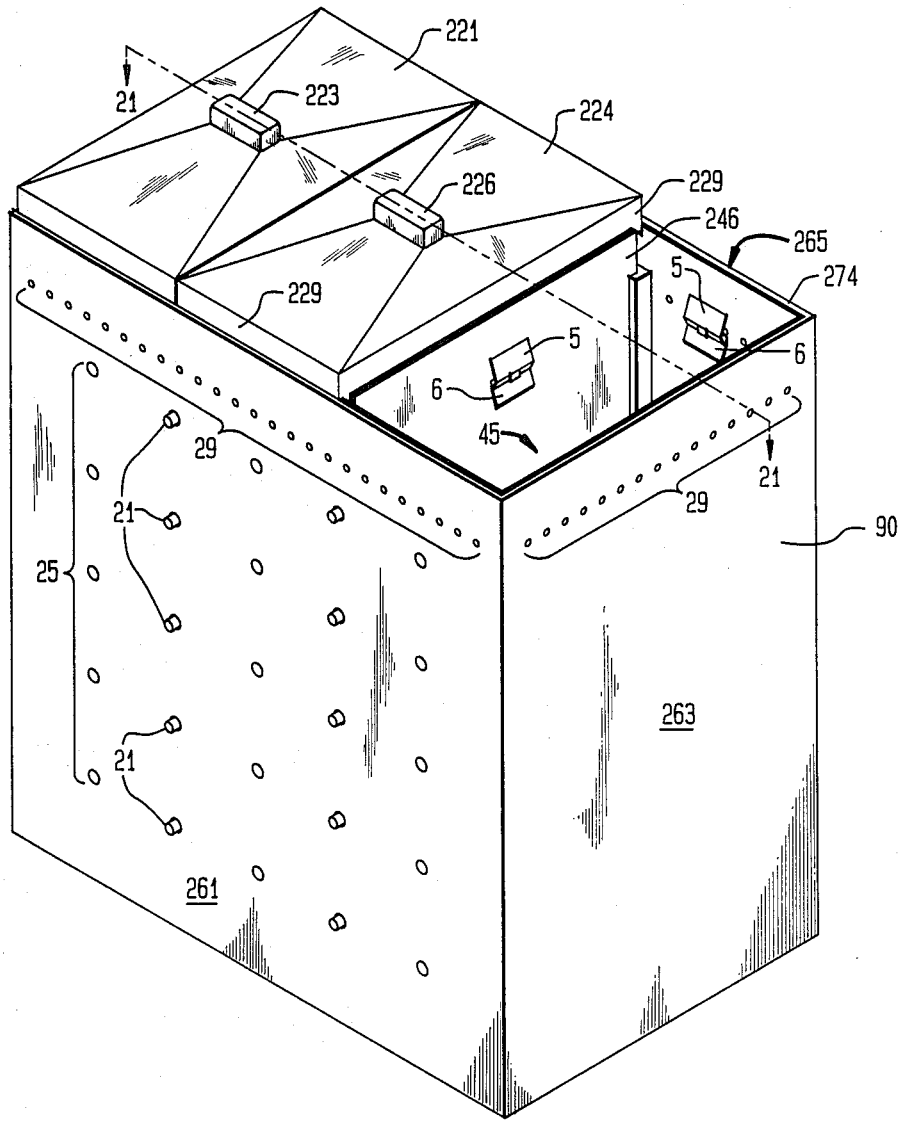
FIG. 20 depicts a front perspective view of a ninth embodiment of the inventive trash receptacle.
Figure 21:
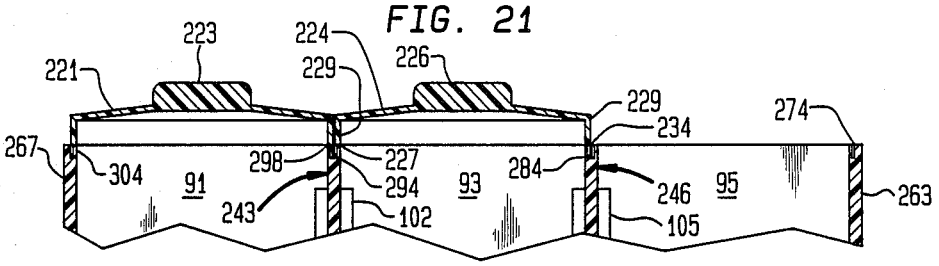
FIG. 21 depicts a partial cross-sectional view, taken along lines 21—21, of the embodiment shown in FIG. 20.
Figure 20:
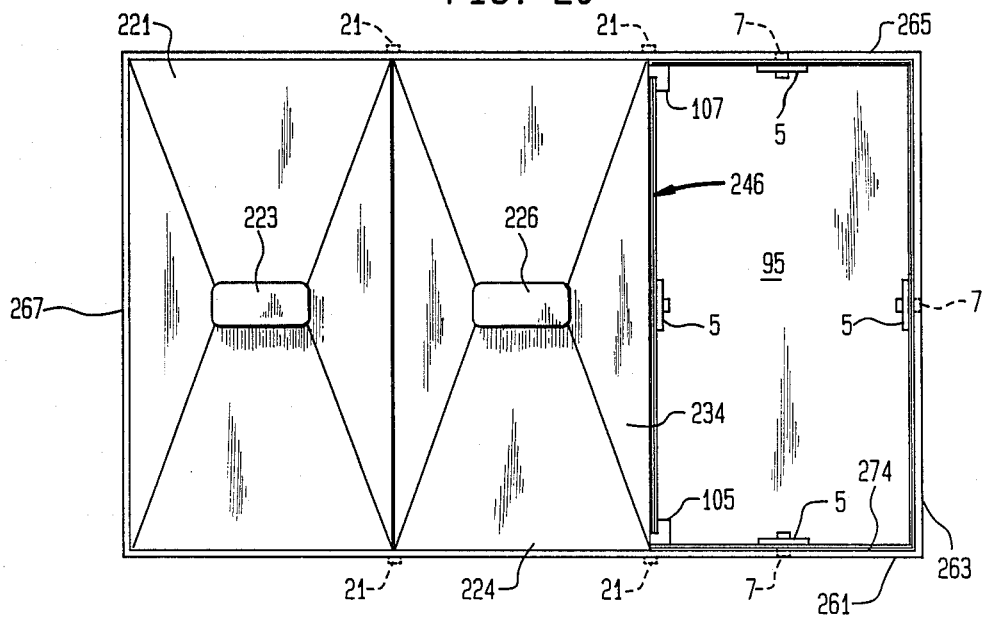

Lastly, FIG. 20 depicts a front perspective view of a ninth embodiment of the inventive trash receptacle. A partial cross-sectional view of this embodiment taken along lines 21—21 is depicted in FIG. 21. A top view of this embodiment is shown in FIG. 22. This embodiment utilizes separate removable lids, such as lids 221 and 224, which each matingly abut and engage with the top edges of the receptacle and with one or both of partitions 294 and 284 to form totally separate closeable compartments 91, 93 and 95 within the receptacle. Specifically, receptacle 90 includes u-shaped channel 274 which is cut into the top edge of front side 261, right side 263, back side 265 and left side 267 of receptacle 90. Hence, channel 274 peripherally extends completely around the top edge of the receptacle. Additional u-shaped channels 234, 284, 294 and 298 are cut into the top edges of partitions 246 and 298. In particular, channels 234 and 284 are situated adjacent to each other in the top edge of partition 246; while channels 294 and 298 are situated adjacent to each other in the top edge of partition 243. All the channels have substantially the same width which is not critical. With the exception of the channels appearing therein, partitions 243 and 246 are identical to partitions 103 and 106 (see FIG. 10), respectively. A removable lid, illustratively one that has a slight truncated pyramidal shape such as lid 221, is positioned on top of a respective compartment, such as compartment 91, to close that compartment. Each lid contains a side member, such as side member 229 contained within lid 224, which has a uniform thickness and extends completely around a lower peripheral portion of the lid. This side member has a base portion, such as base member 227 in lid 224, that has a reduced thickness that substantially equals the width of the channels into which the lid will matingly engage. In this manner, a lid can be positioned on top of a compartment and engage with the channels in the receptacle so as to completely seal that compartment. Each lid, such as lids 221 and 224, has a handle, such as respective handles 223 and 226, to readily permit a user to grasp and easily lift the lid. Although this embodiment is shown as containing two lids, it can contain three to separately seal each of the three compartments contained within this embodiment. Clearly, this embodiment can contain any number of compartments, each having a separate corresponding lid. In addition, this embodiment also contains clips 5 (along with accompanying mounting holes 29) for holding a suitable plastic bag in an open position within each compartment.

Clearly, although the partitions, in these embodiments, have been shown as being movable, any of these partitions can be molded as part of the container and thereby assume a permanent position. In addition, even though the runners have been shown as also being movable, any or all of the runners, for any of the embodiments, can be molded as part of the container. In fact, a series of runners can be molded into the inside surface of the container to simply permit a user to drop one or more partitions into place where desired without the necessity of mounting any runners. Either of these changes might increase the expense of manufacturing the container somewhat but will significantly make the container easier for a user to configure.

Although various embodiments have been shown and described herein, these embodiments merely illustrate the teachings of the present invention. Clearly, those skilled in the art may readily construct many other varied embodiments that still incorporate these teachings.

I claim:

1. Apparatus for a receptacle for separately storing different recyclable materials of divergent bulk in separate compartments in said receptacle, said apparatus comprising:

a container being open at one end thereof and having a base with a pre-defined geometric shape at an opposite end thereof, and having inner and outer walls defining the configuration of said container; and at least one partition within said container and oriented to run from the base of said container to substantially the top thereof so as to divide said container into separate pre-defined compartments of predetermined selectable volume for separately storing said different respective recyclable materials therein;

at least one pair of two runners, each of said runners having a U-shaped channel appearing therein and affixed in a pre-defined vertical position to abut against one of two of said oppositely situated inner walls such that the channels of said runners directly face each other; and wherein said partition slidably engages with and fits between both of said channels in said runners;

means, secured at a pre-defined point on adjacent inner and outer walls of said container and within a respective one of said compartments, for holding a storage bag in a pre-defined open position within said compartment;

wherein said partition within said container is selectively positionable along the inner and outer walls of said container in defining said separate compartments into compartments of predetermined, selectable volume according to the divergent bulk of the recyclable materials to be stored therein;

wherein said holding means comprises a spring loaded clip;

wherein said spring loaded clip further comprises a flat plate that abuts against said adjacent inner and outer walls, an arm, and a spring loaded hinge which is secured at one end thereof to said plate and at another end thereof to one end of said arm for holding an opposite end of said arm against said plate and thereby holding a pre-defined portion of said storage bag against said plate;

and wherein said clip further comprises a pin situated on a rear surface of said plate and protruding outward therefrom; and said container further comprises a horizontally oriented series of holes situated near the top of said adjacent inner and outer walls such that said pin on said plate matingly engages with any one of said horizontally oriented holes in order to secure said clip in a pre-defined lateral position on said adjacent inner and outer walls of said container.

2. The apparatus in claim 1 wherein said base is circular to configure said container with a cylindrical shape.

3. The apparatus in claim 2 wherein said container further comprises:

a vertical series of holes located in each of two oppositely situated inner and outer walls of said container forming side walls thereof, wherein said series is replicated at pre-defined horizontal positions running along each of said oppositely situated side walls; and wherein each of said runners has a substantially flat rear surface and at least one pin protruding therefrom, such that said pin matingly engages with a hole in any one of said corresponding vertical series of holes in order to secure said runner in a pre-defined vertical position to a side wall of said container.

4. The apparatus in claim 1 wherein said container further comprises:

a vertical series of holes located in each of two oppositely situated inner and outer walls of said container forming side walls thereof, wherein said series is replicated at pre-defined horizontal positions running along each of said oppositely situated side walls; and wherein each of said runners has a substantially flat rear surface and at least one pin protruding therefrom, such that said pin matingly engages with a hole in any one of said corresponding vertical series of holes in order to secure said runner in a pre-defined vertical position to a side wall of said container.

5. The apparatus in claim 4 further comprising a top assembly formed of a skirt, that abuts against and overhangs a top edge of said container, and an upper frame member directly disposed above said skirt wherein said upper frame member comprises:

at least two oppositely situated upwardly extending parallel side members having respective opposing horizontally oriented channels appearing therein; and a panel situated between said side members which slidably engages with a respective parallel channel in each of said side members such that said panel can be slid into a position to expose at least one of said compartments at a time.

6. The apparatus in claim 4 further comprising a top assembly formed of a skirt, that abuts against and overhangs a top edge of said container, and an upper frame member directly disposed above said skirt wherein said upper frame member comprises at least one rectangularly shaped door, said door being connected at one end thereof to a hinge that is secured to a top edge of a respective partition such that said door is capable of being pivotally moved upward to expose said compartment.

7. The apparatus in claim 6 wherein said door further comprises a rectangularly shaped panel which fits within a correspondingly shaped cutout in said door and is connected at one end thereof to a spring loaded hinge, said hinge being connected at another end thereof to said door such that said panel can pivotally move downward to expose a compartment situated under said door and then move pivotally upward to return to a closed position without said door be lifted.

8. The apparatus in claim 6 wherein said door is formed of a plurality of telescoping sections which can be moved inward or outward to change the width of said door such that said width can be matched to the width of the compartment which is situated under said door.

9. The apparatus in claim 4 further comprising:

a second U-shaped channel located within the top edge of all of said side walls;

third and fourth U-shaped channels situated within the top edge of each of said partitions, wherein said third and fourth channels are substantially identical to said second U-shaped channels; and at least one lid having a slightly truncated pyramidally shaped upper portion and side members which downwardly extend therefrom, wherein a bottom edge of said side member matingly engages with corresponding ones of said channels so as to seal a compartment of said receptacle.

10. Apparatus for a receptacle for separately storing different recyclable material of divergent bulk in separate compartments in said receptacle, said apparatus comprising:

a container being open at one end thereof and having a base with a pre-defined geometric shape at an opposite end thereof, and having inner and outer walls defining the configuration of said container; and at least one partition within said container and oriented to run from the base of said container to substantially the top thereof so as to divide said container into separate pre-defined compartments of predetermined selectable volume for separately storing said different respective recyclable materials therein;

at least one pair of two runners, each of said runners having a U-shaped channel appearing therein and affixed in a pre-defined vertical position to abut against one of two of said oppositely situated inner walls such that the channels of said runners directly face each other; and wherein said partition slidably engages with and fits between both of said channels in said runners;

means, secured at a pre-defined point on adjacent inner and outer walls of said container and within a respective one of said compartments, for holding a storage bag in a pre-defined open position with said compartment;

wherein said partition within said container is selectively positionable along the inner and outer walls of said container in defining said separate compartments into compartments of predetermined, selectable volume according to the divergent bulk of the recyclable materials to be stored therein;

and wherein said holding means comprises a spring loaded clip having a flat plate that abuts against said adjacent inner and outer walls, an arm, and a spring loaded hinge which is secured at one end thereof to said plate and at another end thereof to one end of said arm for holding an opposite end of said arm against said plate and thereby holding a pre-defined portion of said storage bag against said plate;

and wherein said clip further comprises a pin situated on a rear surface of said plate and protruding outward therefrom; and said container further including a horizontally oriented series of holes situated near the top of said adjacent inner and outer walls such that said pin on said plate matingly engages with any one of said horizontally oriented holes in order to secure said clip in a pre-defined lateral position on said adjacent inner and outer walls of said container;

and wherein said container further comprises a vertical series of holes located in each of two oppositely situated inner and outer walls of said container forming side walls thereof, wherein said series is replicated at pre-defined horizontal positions running along each of said oppositely situated side walls; and wherein each of said runners has a substantially flat rear surface and at least one pin protruding therefrom, such that said pin matingly engages with a hole in any one of said corresponding vertical series of holes in order to secure said runner in a pre-defined vertical position to a side wall of said container.

11. The apparatus of claim 1 wherein said base is orthogonal to configure said container with a rectangular shape and including a pair of partitions within said container and selectively positionable along the inner and outer walls thereof in defining three separate rectangular side-by-side compartments of predetermined, selectable volumes, and also including two pair of two runners each to slidably receive said pair of partitions in place.

* * * * *